US006098717A

United States Patent [19]

Bailey et al.

[11] Patent Number: 6,098,717

[45] Date of Patent: Aug. 8, 2000

[54] METHOD AND APPARATUS FOR HANGING TUBULARS IN WELLS

[75] Inventors: Gary L. Bailey, San Antonio, Tex.; Leo D. Hudson, Bakersfield, Calif.; Sherman R. Warren, Crowley; Ross S. Woods, Grand Prairie, both of Tex.

[73] Assignee: Formlock, Inc., San Antonio, Tex.

[21] Appl. No.: 08/947,069

[22] Filed: Oct. 8, 1997

[51] Int. Cl.[7] ..... E21B 23/02

[52] U.S. Cl. ..... 166/382; 166/207; 166/217

[58] Field of Search ..... 166/217, 243, 166/339, 360, 381, 382, 207, 277

[56] References Cited

U.S. PATENT DOCUMENTS

| | | | |
|---|---|---|---|
| Re. 30,802 | 11/1981 | Rogers, Jr. . | |
| 2,017,451 | 10/1935 | Wickersham | 166/277 X |
| 2,214,226 | 9/1940 | English | 166/1 |
| 2,245,471 | 6/1941 | Garvin | 192/20 |
| 2,377,249 | 5/1945 | Lawrence . | |
| 2,732,901 | 1/1956 | Davis | 166/98 |
| 2,734,581 | 2/1956 | Bonner | 166/98 |
| 2,965,175 | 12/1960 | Ransom | 166/98 |
| 2,984,302 | 5/1961 | Church | 166/98 |

(List continued on next page.)

FOREIGN PATENT DOCUMENTS

| | | |
|---|---|---|
| 1153322 | 9/1983 | Canada . |
| 1157689 | 11/1983 | Canada . |
| 1158682 | 12/1983 | Canada . |
| 1170921 | 7/1984 | Canada . |
| 1176040 | 10/1984 | Canada . |
| 1191436 | 8/1985 | Canada . |
| 1192029 | 8/1985 | Canada . |
| 1193526 | 9/1985 | Canada . |
| 1213761 | 11/1986 | Canada . |
| 1217415 | 2/1987 | Canada . |
| 0 289 103 | 11/1988 | European Pat. Off. . |
| 203767 | 11/1983 | Germany . |
| 2093667 | 10/1997 | Russian Federation . |
| 388650 | 2/1976 | U.S.S.R. . |
| 663825 | 5/1979 | U.S.S.R. . |
| 746084 | 7/1980 | U.S.S.R. . |
| 832049 | 5/1981 | U.S.S.R. . |
| 976019 | 11/1982 | U.S.S.R. . |
| 1028836 | 7/1983 | U.S.S.R. . |
| 1086118 | 4/1984 | U.S.S.R. . |
| 1109509 | 8/1984 | U.S.S.R. . |
| 1668615 A1 | 10/1991 | U.S.S.R. . |
| 1813171 A3 | 4/1993 | U.S.S.R. . |
| WO 99/06670 | 2/1999 | WIPO . |

OTHER PUBLICATIONS

Halliburton 1 –Stressed Steel Liner Process, 4 p. brochure.
Halliburton 2 –Special Tools –Technical Data Sheet– Stressed Steel Liner Process, 2 p. brochure.

*Primary Examiner*—Frank Tsay
*Attorney, Agent, or Firm*—Lyon & Lyon LLP

[57] ABSTRACT

A well tubular is hung within a casing through placement of the tubular in overlapping relationship with the casing. A spacer may be located therebetween. The tubular is expanded which in turn expands the spacer when used. The tubular is expanded beyond the yield point such that it or an intervening spacer engages the inside of the casing and stresses the casing within its elastic limits. The assembly then contracts to form a tight structural support between the tubulars and a high pressure seal against flow therebetween. A spacer having channels about either end with ductile sealing material therein is of an expanded metal material through cuts in the sheet. A hydraulic ram is employed with an expandable collet to draw the collet through the overlapping area of the liner and the casing. The collet extends within a shoulder at the end of its stroke such that it will be substantially released from the upper end of the liner. A method for placing a lateral liner includes expanding the liner to beyond its yield point within the hole through the casing. The stub of the liner positioned within the casing may then be drilled out such that completed lateral and main bores are achieved.

64 Claims, 6 Drawing Sheets

U.S. PATENT DOCUMENTS 3,067,801 12/1962 Sortor .
3,179,168 4/1965 Vincent ..... 166/14
3,186,485 6/1965 Owen ..... 166/63
3,191,677 6/1965 Kinley .
3,203,483 8/1965 Vincent ..... 166/207
3,245,471 4/1966 Howard ..... 166/46
3,326,293 6/1967 Skipper ..... 166/150
3,353,599 11/1967 Swift ..... 166/15
3,412,565 11/1968 Lindsey et al. .
3,477,506 11/1969 Malone ..... 166/207
3,489,220 1/1970 Kinley ..... 166/277
3,583,200 6/1971 Cvijanovic ..... 72/393
3,669,190 6/1972 Sizer et al. ..... 166/315
3,691,624 9/1972 Kinley ..... 29/523
3,712,376 1/1973 Owen et al. ..... 166/277
3,746,091 7/1973 Owen et al. ..... 166/207
3,776,307 12/1973 Young .
3,780,562 12/1973 Kinley ..... 72/479
3,785,193 1/1974 Kinley et al. ..... 72/393
3,827,727 8/1974 Moebius .
3,948,321 4/1976 Owen et al. ..... 166/277
4,359,889 11/1982 Kelly ..... 72/62
4,362,324 12/1982 Kelly ..... 285/119
4,382,379 5/1983 Kelly ..... 73/46
4,387,502 6/1983 Dom ..... 29/568
4,407,150 10/1983 Kelly ..... 72/61
4,414,739 11/1983 Kelly ..... 29/727
4,445,201 4/1984 Pricer ..... 365/154
4,450,612 5/1984 Kelly ..... 72/62
4,470,280 9/1984 Kelly ..... 72/61
4,483,399 11/1984 Colgate ..... 166/308
4,487,630 12/1984 Crook et al. ..... 75/123 B
4,502,308 3/1985 Kelly ..... 72/58
4,505,017 3/1985 Schukei .
4,505,142 3/1985 Kelly ..... 72/54
4,505,612 3/1985 Shelley, Jr. ..... 405/101
4,567,631 2/1986 Kelly ..... 29/157.3
4,581,617 4/1986 Yoshimoto et al. ..... 346/108
4,767,310 8/1988 Neumann et al. .
4,793,382 12/1988 Szalvay .
4,830,109 5/1989 Wedel .
4,976,322 12/1990 Abdrakhamanov et al. ..... 175/57
5,070,941 12/1991 Kilgore .
5,307,879 5/1994 Kent ..... 166/382
5,348,095 9/1994 Worrall et al. ..... 166/380
5,366,012 11/1994 Lohbeck ..... 166/277
5,664,327 9/1997 Swars .
5,785,120 7/1998 Smalley et al. .
5,787,933 8/1998 Russ et al. .
5,794,702 8/1998 Nobileau .
5,857,524 1/1999 Harris et al. .

METHOD AND APPARATUS FOR HANGING TUBULARS IN WELLS

BACKGROUND OF THE INVENTION

The field of the present invention is well drilling and completion systems.

Well drilling and completion equipment includes tubulars which are variously characterized as casing, tubing and liner. For universal application, they are cylindrical in shape and of a length in compliance with the American Petroleum Institute Standard 5C. The term "casing" is typically applied to tubulars which are larger in diameter and used to support the earth's encroachment when drilling a bore hole for a well. Often casing is cemented to the bore hole to define a sound structural member and to prevent migration of unwanted gases, water or other fluids outwardly of the casing. Casing is typically assembled from 40 foot long tubulars with threaded couplings. Wells can extend for several miles into the earth. As the well increases in depth, the hydraulic pressures to which the casing is subjected to increase. Decreases in casing diameter with increasing depth is common, often to avoid experiencing excessive force from such high pressures. Such decreases typically occur in step function as smaller casing is employed.

"Liner" is typically made up of tubulars in an area of well production. Liner can have portions with slots prefabricated through the wall, end closure elements and the like. Liner is typically smaller in diameter than casing and is typically placed in wells after casing to extend from casing into production zones.

Other tubing may be employed within casing to bring production to the surface and for other communication within wells. This too is placed in wells after casing and has a reduced diameter.

To insure the flow of fluids with or without entrained solids are appropriately directed within wells, packers or annular seals are frequently employed to span gaps at radial steps in tubular construction within wells. Packers are also employed to insure the blockage of pressure from unwanted areas.

Additionally, structural support from above frequently is needed for such placements. The compression of tubular strings through placement on the bottom is often considered to be detrimental to the pressure integrity of the structure. Consequently, suspending liner or casing in tension is preferred. Hangers typically are used which employ wedges or other structural devices to grip the inner tubular. Combinations of packers and hangers are also used.

SUMMARY OF THE INVENTION

The present invention is directed to methods for hanging tubulars in wells including the expansion of the inner tubular beyond its elastic limit outwardly against an outer tubular with the outer tubular experiencing sufficient deformation to place the final assembly in a tight relationship. Tubular hanging is accomplished. Sealing may also be achieved. Apparatus to these ends is separately contemplated.

In a first separate aspect of the present invention, a method for hanging an inner tubular and an outer tubular includes an overlapping of the tubulars. The inner tubular is expanded partially or fully circumferentially past the yield point and the outer tubular is expanded partially or fully circumferentially by the inner tubular, the expansion being sufficient that elastic recovery for the inner tubular is less than elastic recovery for the outer tubular. A structural hanging of the inner tubular on the outer tubular is thus accomplished. Depending on the materials employed, a sealing may also be accomplished at the same time. Additional ductile sealing material may be employed as well. The foregoing can be accomplished without expanding the outer tubular beyond the yield point when that is preferred.

In a second separate aspect of the present invention, a method for hanging a first tubular and a second tubular includes an overlapping of the tubulars with a spacer therebetween which is substantially incompressible in the radial direction. The inner tubular is expanded partially or fully circumferentially past the yield point and the outer tubular is expanded partially or fully circumferentially by the spacer. A structural hanging of the inner tubular on the outer tubular is thus accomplished. Depending on the materials employed, a sealing may also be accomplished at the same time. The spacer may have seals and structure allowing for its easy partial or full expansion circumferentially through portions thereof. Additional ductile sealing material may be employed as well.

In a third separate aspect of the present invention, the prior aspects are contemplated to be specifically employed for hanging cylindrical liners within cylindrical casings.

In a fourth separate aspect of the present invention, laterally hanging a tubular is accomplished through drilling diagonally through the wall of a casing, placing a tubular through that wall and expanding the tubular past the yield point and the casing by the tubular. The tubular extending into the casing may then be drilled out. In this way, access to the main bore as well as to the lateral bore or bores remains.

In a fifth separate aspect of the present invention, a spacer contemplated for use between tubulars of different diameters is contemplated. A tubular body includes inner and outer circumferential channels with ductile seals arranged therein. Longitudinal slits through the wall of the tubular body facilitate expansion of the spacer. The slits are staggered and do not extend to the circumferential channels.

In a sixth separate aspect of the present invention, a tubular expander includes a hydraulic ram with a shoulder and a draw bar extending through the shoulder. A collet is associated with the draw bar and cooperates with the draw bar through beveled surfaces to effect a selected expanded state. An annular piston may be employed to move the collet on the draw bar to control collet expansion. The shoulder on the hydraulic ram may also be extended to receive at least a portion of the collet such that the maximum diameter of the collet may be drawn substantially fully through the end of the tubular.

In a seventh separate aspect of the present invention, the tubular expander of the prior aspect is contemplated to be associated with a tubular with the collet expanded to firmly engage the tubular.

In an eighth separate aspect of the present invention, combinations of the foregoing aspects are contemplated.

Accordingly, it is an object of the present invention to provide hanging methods for wells and apparatus associated therewith. Other and further objects and advantages will appear hereinafter.

DETAILED DESCRIPTION OF THE PREFERRED EMBODIMENTS

Figure 1:
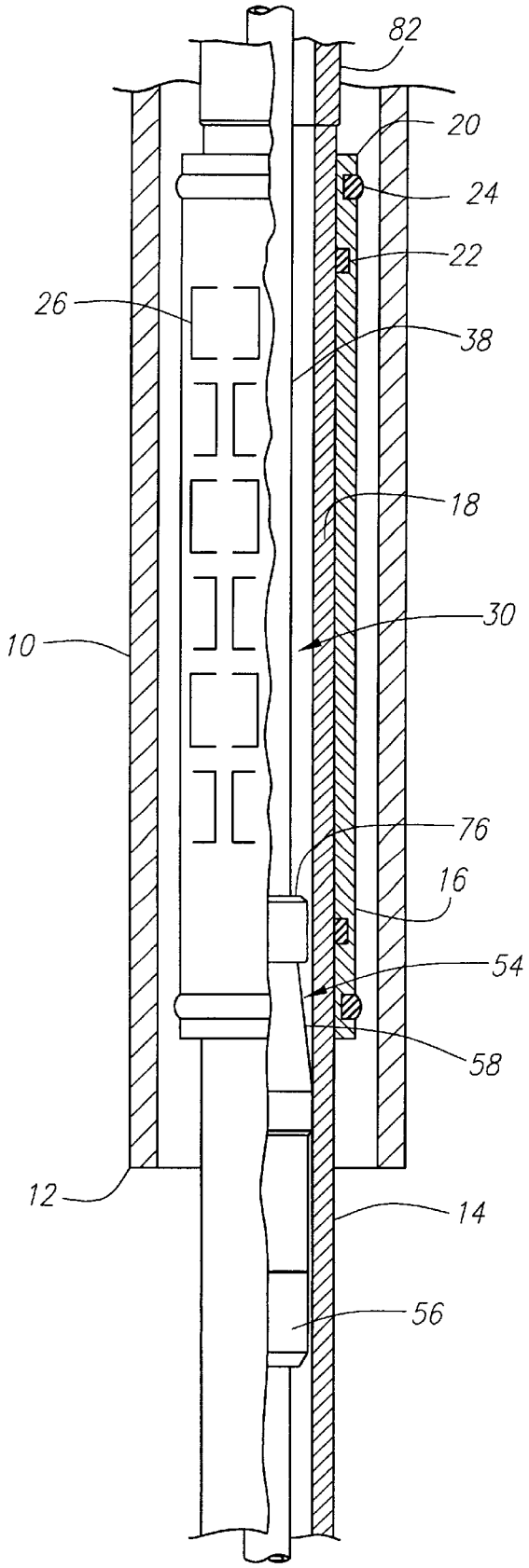
FIG. 1 is a partial cross-sectional view of a tubular within a casing with a tubular expander.
Figure 2:
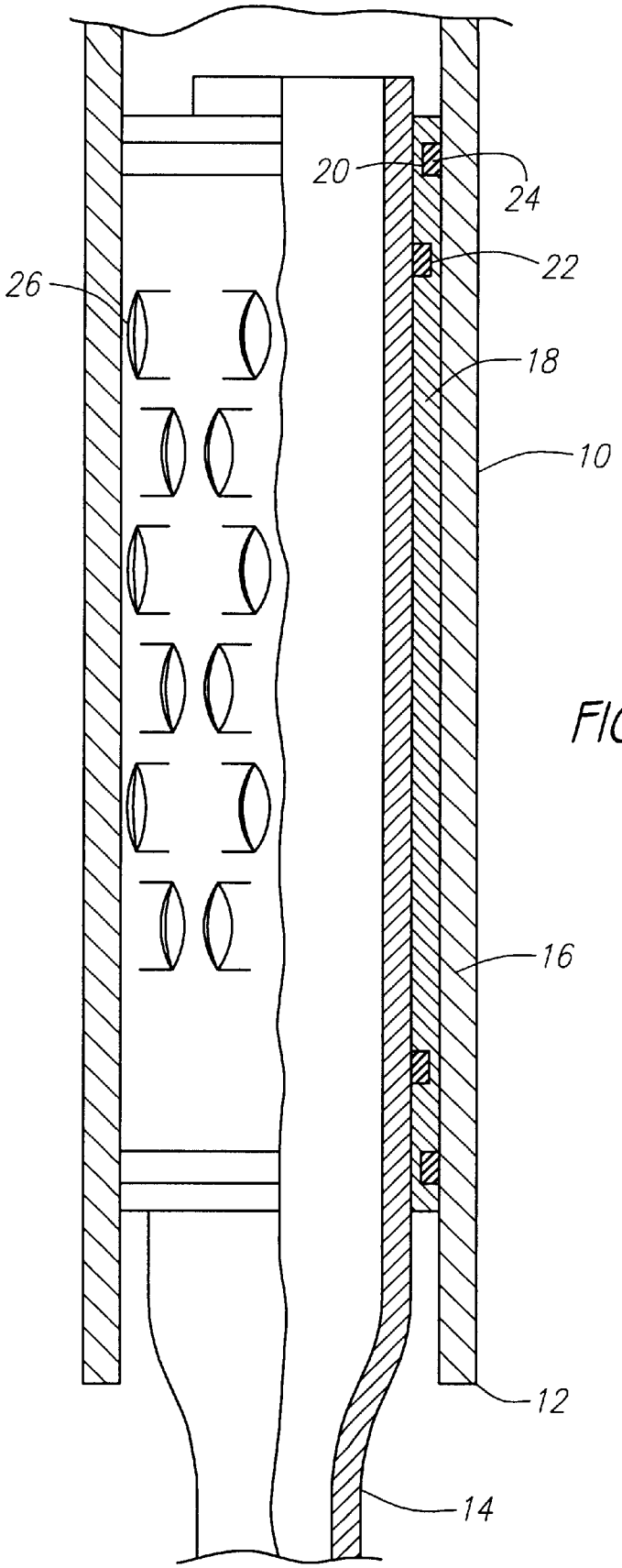
FIG. 2 is a partial cross-sectional view of a tubular within a casing expanded into hanging relationship therewith.

Turning in detail to the drawings, FIG. 1 illustrates a tubular, shown to be a casing 10 in this embodiment, understood to be positioned within a well bore (not shown). The lower end 12 of the casing 10 does not extend to the bottom of the well bore. An assembly for hanging a second tubular, shown to be a liner 14 in this embodiment, within the casing 10 is positioned with the liner 14 in an overlapping relationship with the casing 10. This second tubular may be casing, liner or other tubing with a smaller diameter than the first tubular with which it is positioned. The liner 14 extends further into the well an indeterminate distance. The casing 10 as well as the liner 14 may be drawn from well drilling stock which are conventional standard tubulars.

Figure 4:
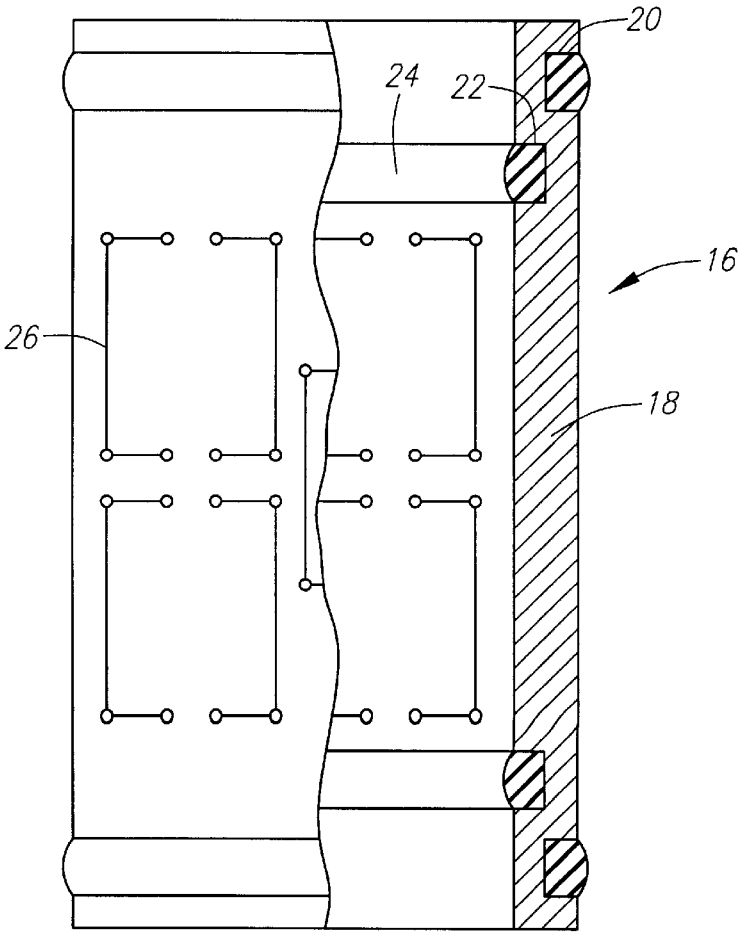
FIG. 4 is a spacer shown in partial cross section.

A spacer 16 may be located between the liner 14 and the casing 10. When a spacer 16 is used, it preferably extends to surround the area of the liner 14 which is overlapping with the casing 10 and which is to be expanded outwardly against the casing 10. A wide variety of spacers 16 may be employed. Separate spaced collars, a wrapping of substantially incompressible filler material and the like are contemplated. One such spacer 16 is best illustrated in FIG. 4.

The spacer includes a tubular body 18 with outer channels 20 near either end. Inner channels 22 are also near either end. Both channels 20 and 22 receive conventional sealing material 24 which is packed to extend in the uncompressed state outwardly from the channels 20 and 22.

The material of the tubular body 18 is to be substantially incompressible in the radial direction. In this regard, the material is preferably similar to that of the casing 10 and the liner 14. As the liner 14 expands, the spacer 16 is anticipated to transfer certain of the load outwardly into the casing 10. The substantially incompressible nature is that which is sufficient to accomplish an appropriate force transfer.

The tubular body 18 further has slits 26. These slits are longitudinally staggered such that angularly adjacent such slits 26 are displaced longitudinally as can be seen in FIG. 4. The slits preferably do not extend longitudinally along great distances. C-shaped slits 26 are contemplated as specifically illustrated. The slits 26 act to create an expandable metal structure which resists partial or full circumferential expansion substantially less than the tubular liner 14. Even so, radial incompressibility is not significantly compromised.

The slits 26 do not extend fully to the ends of the tubular body 18 or even so far as the channels 20 and 22. In this way, an annular closed collar is defined at each end. Each collar will require additional force for expansion. The ductile sealing material 24 will easily expand partially or fully circumferentially within the channels 20 and 22.

Figure 3:
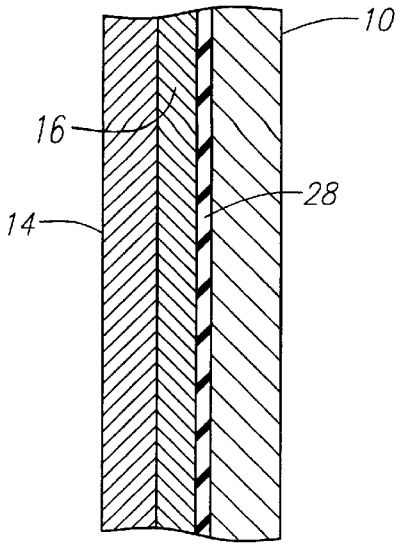
FIG. 3 is a cross-sectional detail view of the wall of FIG. 2 with an added seal layer.

A ductile sealing material which may be a polymeric substance or a ductile metal filler material may overlay the liner or the pacer 16 when one is employed. One such ductile sealing layer 28 is illustrated in the detail of FIG. 3. A similar sealing layer (not shown) may also or alternatively be employed where appropriate between the liner 14 and the spacer 16.

A tubular expander is illustrated for cooperation with the liner 14. This tubular expander, generally designated 30, is shown in detail in FIGS. 5A and 5B and is shown in position before expansion in FIG. 1.

The tubular expander 30 includes a hydraulic ram 32 which includes a cylinder 34 having ram annular pistons 36 and 37. A draw bar 38 is positioned inwardly of the cylinder 34. The draw bar 38 has a central bore 40 which may be closed at the distal end thereof by a cap 42 or other means such as additional equipment further down hole. The draw bar 38 includes shoulders 44 and 46 which, with the bar itself, the cylinder 34 and the ram annular pistons 36 and 37 define ram expansion spaces 48 and 50, respectively. Lip seals or O-rings are appropriately positioned to ensure sealing of the ram expansion spaces 48 and 50. The shoulder 46 is shown to be a separate element rather than integral as is shoulder 44. This is appropriate for ease of assembly. Further, additional shoulders 46 may be associated with additional ram annular pistons 36 and 37 where more force is necessary. Passages 52 are shown to extend from the central bore 40 to the ram expansion spaces 48 and 50 for the delivery of high pressure fluid. Relief passages 53 avoid pressure buildup behind the piston 37 as the hydraulic ram 32 moves through its stroke.

Depending upon the pressure which may be necessary for expanding a tubular, not only may force advantage be achieved through the multiplication of ram annular pistons 36 but a hydraulic intensifier may be employed above the tubular expander 30. The principles of hydraulic intensifiers are well known as requiring a small input piston capable of traveling through a relatively large distance and driving a larger output piston capable of traveling through a much shorter distance and exerting a far higher force. The hydraulic force generated by the larger piston would then be input into the central bore 40 for distribution through the passages 52 into the ram expansion spaces 48 and 50.

The draw bar 38 extends from the cylinder 34 and receives a collet, generally designated 54. The collet 54 includes a ring 56 at its lower end formed in two potions for ease of manufacture. Segments 58 extend from the ring 56 about the draw bar 38 and toward the hydraulic ram 32. These segments 58 are cantilevered from the ring 56 such that they may be forced to expand outwardly from a retracted force neutral position. Slots 60 define the segments 58 and are shown to include a jog at the thickest portion of the collet 54 so as to provide continuous expansion force about the entire collet.

The draw bar 38 includes a beveled outer surface portion 62 and an outer shoulder 64 which extend fully about the draw bar 38. Each segment 58 similarly includes a beveled inner surface portion 66 with an inner shoulder 68 facing the outer shoulder 64 on the draw bar 38. As can be seen from FIGS. 5A and 5B, as the collet 54 moves downwardly relative to the draw bar 38, the beveled outer surface portion 62 and the beveled inner surface portion 66 act together to expand the segments 58 outwardly in a radial direction. The outer shoulder 64 and the inner shoulder 68 cooperate to limit the relative travel between the collet 54 and drawbar 38 so as to limit the expansion of the collet.

To effect the foregoing relative longitudinal displacement of the collet 54 on the draw bar 38, an annular piston 70 associated with the ring 56 of the collet 54 cooperates with the draw bar 38 to define an expansion space 72. A further passage 74 extends from the central bore 40 to the expansion space 72. Seals about the expansion space 72 inhibit leakage. Thus, the pressure commencing to draw the hydraulic ram 32 upwardly also drives the collet 54 downwardly to expand the segments 58.

Figure 5A:
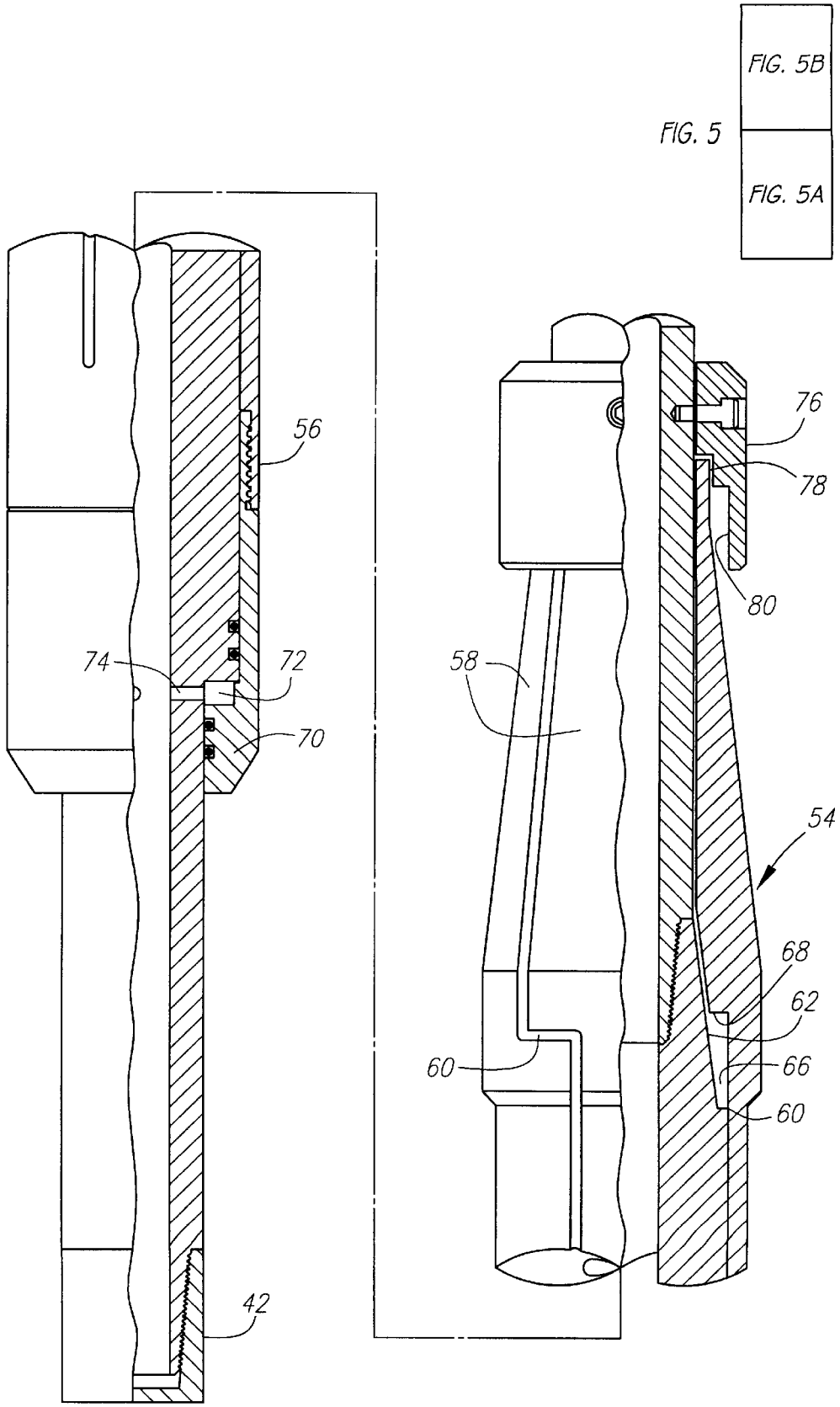
FIGS. 5A and 5B show a tubular expander illustrated in partial cross section.
Figure 5B:
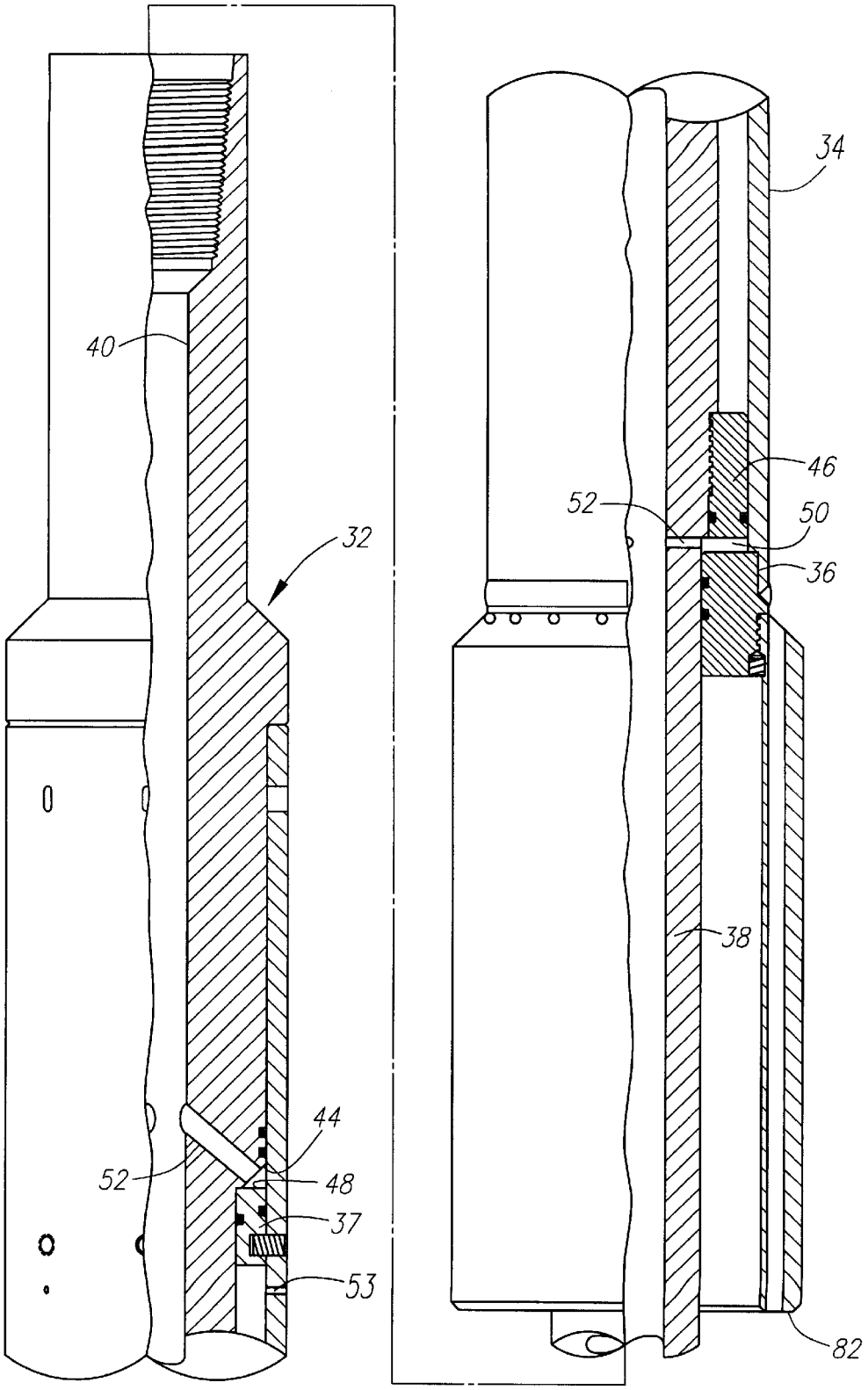

A retaining ring 76 located at the distal end of the segments 58 is affixed to the draw bar 38. This ring 76 includes a first cavity 78 to retain the ends of the segments 58 when in the contracted state as illustrated in FIGS. 5A and 5B and a second cavity 80 to retain the ends of the segments 58 when in the expanded state.

Referring back to the cylinder 34 of the hydraulic ram 32, a shoulder 82 is located at the lower end of the cylinder 34 and displaced therefrom. The draw bar 38 extends through this shoulder 82. The extension of the shoulder 82 is of sufficient length and inner diameter such that it can receive the upper end of the collet 54 and the retainer ring 76. The extension of the shoulder 82 is to the maximum diameter of the collet 54 when in the expanded state. Extraction of the tubular expander assembly once drawn through the full stroke is thereby accomplished without further tubular expansion of the liner 14.

In operation, a smaller diameter tubular, such as the liner 14, selected to be placed within a larger diameter tubular, such as the casing 10, already in position within a well. A spacer 16 may first be positioned about the liner 14 adjacent one end, particularly if the necessary expansion of the liner 14 would otherwise be excessive. The spacer or spacer elements are selected to extend substantially the length of the portion of the liner 14 to be expanded. Ductile sealing material may be added about the liner. Where a spacer is present, such ductile sealing material may be either inwardly of the spacer 16 or outwardly of the spacer 16 or both.

Once the tubular has been prepared, a tubular expander is placed therein. A tubular expander is selected with the appropriate piston stroke to expand a preselected length of the liner 14. The draw bar 38 is extended such that the widest area of the collet 54 is in location to expand the desired portion of the liner 14. With a spacer involved, the collet is arranged just longitudinally outwardly of the spacer 16. With the appropriate length selected, the shoulder 82 on the hydraulic ram 32 abuts against the near end of the liner 14. Some pressure may be supplied to the central bore 40 so as to set the collet 54 within the liner 14 with enough force so that the entire liner assembly can be supported by the collet 54 as the assembly is lowered into the well.

Once in position with the liner 14 overlapping the casing 10 at least to the extent of the spacer 16, high pressure fluid is directed down the drill pipe to the central bore 40 of the draw bar 38. This pressure acts to drive the collet 54 on the draw bar 38 to the fully expanded position. The pressure also acts to draw the expanded collet 54 upwardly through the liner 14 toward the shoulder 82 of the hydraulic ram 32.

The inner diameter of the casing 10 and the outer diameter of the liner 14 are selected along with the appropriate thickness of the spacer 16, if used, such that operation of the collet 54 being drawn through the portion of the liner 14 will expand the liner which in turn expands the spacer 16. The expansion of the liner 14 is beyond the yield point of the material. In this way the gap necessary for placement, either between the liner 14 and the casing 10 or the spacer 16 and the casing 10, is permanently closed. The yield point of any material is determined by convention, typically at 0.2% offset yield. Because of the necessary gap, significant plastic strain beyond the yield point is anticipated.

Either the liner 14 itself or the spacer 16 extends outwardly to expand the casing 10. The assembly is preferably but not necessarily selected such that the expansion of the casing 10 remains within the elastic limit of the material. The elastic expansion of the casing 10 is such that, with the tubular expander withdrawn, the casing 10 is able to rebound enough to remain tight against the liner 14 or the spacer 16 and in turn the liner 14. Further, it is commonly understood that the materials of oil field tubulars are able to be stretched in the yield range to as much as about 10% to 20% or more without experiencing a significant decrease in strength. Competing effects of work hardening and reduction in cross-section accompanying the inelastic strain results. With continued expansion, the reduction in cross section becomes the dominant factor and strength decreases. The strength of concern is typically the longitudinal tensile strength of the tubular.

When expanded, the inner tubular expands more than the outer tubular per unit of circumference. Likewise, when recovering after the load is removed, the inner tubular will shrink less than the outer tubular to achieve the same ratio of recovery. Consequently, the outer tubular will remain in some tension and the inner tubular will remain in some compression if the two are expanded with the inner tubular expanding in excess of the yield point enough so that the inner tubular cannot recover to a position where tension is removed from the outer tubular. In other words, the outer tubular may remain within the elastic limit but is preferably expanded enough so that its recovery when unloaded by the tubular expander is at least as great as the recovery of the inner tubular. A minimum expansion of both tubulars is preferred to achieve this result. Expansion to the point that a tubular begins to lose strength is avoided except in unusual applications.

Once the collet 54 has been drawn as far as possible through the shoulder 82 by the draw bar 38, it is substantially free from the now expanded liner portion 14. With this accomplished, the drill string with the collet 54 attached can be withdrawn from the well. If other elements are located below the collet 54 on the drill string, they may be employed for gravel packing, cementing and the like.

Figures 6A, 6B, 6C, 6D, 6E, 6F, 6G, 6H:
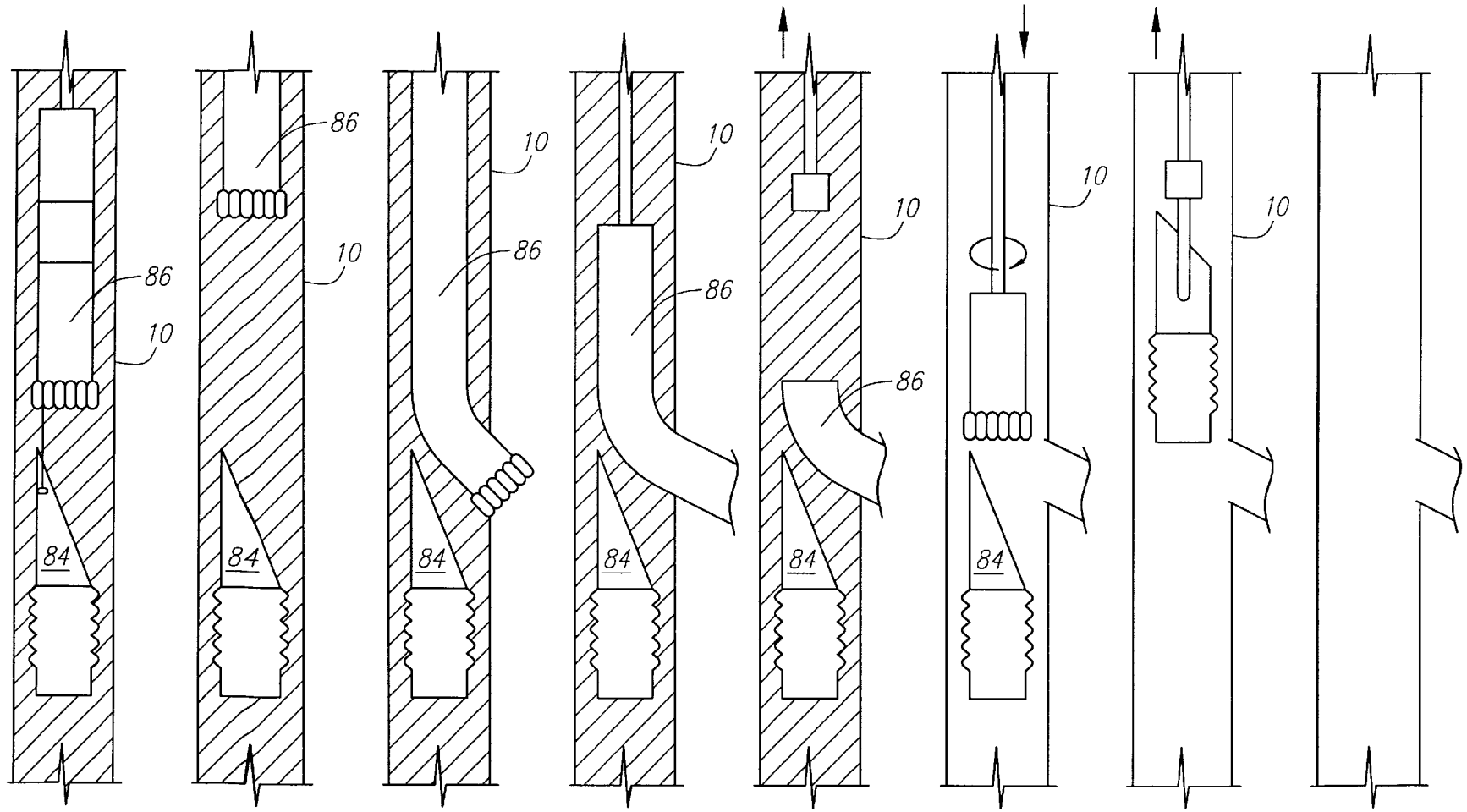
FIGS. 6A–6H are a sequential schematic series of cross sections of a multi-lateral tubular placement.

Turning to the method of laterally hanging a tubular as sequentially illustrated in FIGS. 6A–6H, a first trip down the well with the liner in place includes a whipstock 84 of conventional design in association with a drill in liner 86 typically employing a mud motor and geosteering. In FIG. 6A, the whipstock is being placed. In FIG. 6B the whipstock 84 is now set and disengaged from the drill in liner 86. In FIG. 6C, the drill in liner is shown cutting a window or hole through the casing. The drilling continues until the drill in liner 86 has almost completely passed through the window in the casing. A tubular expander was included as part of the drill in liner assembly. Once the drill in liner 86 has been placed, the collet is opened and drawn through the liner 86 across the window in the casing. The liner 86 expands and becomes fixed within the window of the casing. The attachments are then withdrawn, leaving the drill in liner 86 in place.

In FIG. 6F, a drill is shown being positioned down the well on a second trip to take out the stub of the drill in liner 86 which extends into the interior of the casing. The whipstock is then attached and withdrawn leaving a completed lateral bore and a completed main bore with full bore access. The lateral liner is mechanically connected and provides a high pressure seal.

Accordingly, improved methods and apparatus are disclosed for the hanging of tubulars within a well. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A method for hanging a first tubular assembly in a second tubular positioned in a well, comprising placing the first tubular assembly within the second tubular in an overlapping relationship with the first tubular assembly extending into the well from the second tubular;

holding the first tubular assembly in place;

expanding at least a portion of the first tubular assembly overlapping with the second tubular, which portion is substantially circular in cross section without longitudinal slits therethrough, partially or fully circumferentially past the yield point including drawing a swedge through the portion and expanding the second tubular adjacent the portion of the first tubular assembly partially or fully circumferentially through expansion of the first tubular assembly, the expanding being sufficient that elastic recovery for the first tubular assembly is less than elastic recovery for the second tubular to retain the first tubular assembly in circumferential compression and the second tubular in circumferential tension;

removing the swedge from the first tubular assembly.

2. The method of claim 1, expanding at least a portion of the first tubular further including the second tubular being expanded within the elastic limit of the second tubular.

3. The method of claim 1 further comprising surrounding the portion of the first tubular assembly with ductile sealing material.

4. The method of claim 3, placing the first tubular assembly being of a cylindrical portion thereof.

5. The method of claim 3, surrounding the portion of the first tubular assembly with ductile sealing material being a ductile metal filler material.

6. The method of claim 1, expanding at least the portion of the first tubular assembly further including drawing a swedge through the portion of the first tubular assembly.

7. The method of claim 6, expanding at least the portion of the first tubular assembly further including expanding the swedge as it is drawing through the portion of the first tubular assembly.

8. The method of claim 1, placing the first tubular assembly within the second tubular including the first tubular assembly having substantially at least the same modulus of elasticity as the second tubular.

9. The method of claim 1, placing the first tubular assembly being of a cylindrical portion thereof and expanding the first tubular assembly being fully circumferentially past the yield point and including expanding the second tubular fully circumferentially through expansion of the first tubular assembly.

10. A method for hanging a first tubular assembly in a second tubular positioned in a well, comprising placing the first tubular assembly within the second tubular in an overlapping relationship with the first tubular assembly extending into the well from the second tubular;

holding the first tubular assembly in place;

expanding at least a portion of the first tubular assembly overlapping with the second tubular fully circumferentially past the yield point including expanding the second tubular adjacent the portion of the first tubular assembly fully circumferentially through expansion of the first tubular assembly, the expanding being sufficient that elastic recovery for the first tubular assembly is less than elastic recovery for the second tubular, expanding the first tubular assembly being in the range of increased strength of the first tubular assembly.

11. A method for hanging a first tubular assembly in a second tubular positioned in a well, comprising surrounding a portion of the first tubular assembly with a spacer which is substantially incompressible in a radial direction of the first tubular assembly;

placing the first tubular assembly within the second tubular in an overlapping relationship with the first tubular assembly extending into the well from the second tubular;

holding the first tubular assembly in place;

expanding at least a portion of the first tubular assembly surrounded by the spacer and overlapping with the second tubular partially or fully circumferentially past the yield point including expanding the second tubular partially or fully circumferentially through expansion of the first tubular assembly and the surrounding spacer.

12. The method of claim 11, expanding at least a portion of the first tubular further including the second tubular being expanded within the elastic limit of the second tubular.

13. The method of claim 11, the expansion being sufficient that elastic recovery for the first tubular assembly is less than elastic recovery for the second tubular.

14. The method of claim 11, expanding the first tubular assembly including expanding at least one slit longitudinally of the first tubular assembly along at least a portion of the length of the spacer.

15. The method of claim 14, placing the first tubular assembly being of a cylindrical portion thereof.

16. The method of claim 14, expanding the first tubular assembly including expanding at least one annular closed collar partially or fully circumferentially.

17. The method of claim 11, expanding the first tubular assembly including expanding at least one annular closed collar partially or fully circumferentially.

18. The method of claim 11 further comprising surrounding the portion of the first tubular assembly and the spacer with ductile sealing material.

19. The method of claim 18, surrounding the portion of the first tubular assembly and spacer with ductile sealing material being a polymeric substance.

20. The method of claim 18, surrounding the portion of the first tubular assembly and spacer with ductile sealing material being a ductile metal filler material.

21. The method of claim 11, expanding the first tubular assembly being in the range of increased strength of the first tubular assembly.

22. The method of claim 11, holding the first tubular assembly in place using a hydraulic ram which includes a shoulder and a draw bar including abutting the shoulder of the hydraulic ram against the upper end of the first tubular assembly.

23. The method of claim 22, holding the first tubular assembly in place further including engaging the first tubular assembly with a swedge on the draw bar of the hydraulic ram at an end of the portion of the first tubular assembly to be expanded with the draw bar extending through the portion, expanding at least the portion of the first tubular assembly further including drawing the swedge on the draw bar through the portion of the first tubular assembly.

24. The method of claim 23, expanding at least a portion of the first tubular assembly further including expanding the swedge as it is drawing through the portion of the first tubular assembly.

25. The method of claim 23 further comprising releasing the first tubular assembly by drawing the swedge into the shoulder of the hydraulic ram.

26. The method of claim 11, expanding at least a portion of the first tubular assembly further including drawing a swedge through the portion of the first tubular assembly.

27. The method of claim 26, expanding at least a portion of the first tubular assembly further including expanding the swedge as it is drawing through the portion of the first tubular assembly.

28. The method of claim 27 further comprising releasing the first tubular assembly using a hydraulic ram which includes a shoulder by drawing the swedge into the shoulder of the hydraulic ram.

29. The method of claim 11, placing the first tubular assembly within the second tubular including the first tubular assembly having substantially at least the same modulus of elasticity as the second tubular.

30. A method for hanging a first tubular assembly in a second tubular positioned in a well, comprising surrounding a portion of the first tubular assembly with a spacer which is substantially incompressible in a radial direction of the first tubular assembly;

placing the first tubular assembly within the second tubular in an overlapping relationship with the first tubular assembly extending into the well from the second tubular;

holding the first tubular assembly in place;

expanding at least a portion of the first tubular assembly surrounded by the spacer and overlapping with the second tubular with the first tubular assembly in place partially or fully circumferentially past the yield point including expanding the second tubular partially or fully circumferentially through expansion of the first tubular assembly and the surrounding spacer, the expansion being sufficient that elastic recovery for the first tubular assembly is less that elastic recovery for the second tubular.

31. The method of claim 30, placing the first tubular assembly within the second tubular including the first tubular assembly having substantially at least the same modulus of elasticity as the second tubular.

32. A method for hanging a liner assembly in cylindrical casing within a well, comprising placing the liner assembly within the casing in an overlapping relationship with the liner assembly extending into the well from the casing;

holding the liner assembly in place;

expanding at least a portion of the liner assembly overlapping with the casing, which portion is substantially circular in cross section without longitudinal slits therethrough, with the liner assembly in place partially or fully circumferentially past the yield point including drawing a swedge through the portion and expanding the cylindrical casing partially or fully circumferentially through expansion of the liner assembly, the expansion being sufficient that elastic recovery for the liner assembly is than elastic recovery for the casing to retain the first tubular assembly in circumferential compression and the second tubular in circumferential tension;

removing the swedge from the liner assembly.

33. The method of claim 32, expanding the liner assembly expanding the cylindrical casing within the elastic limit thereof.

34. The method of claim 32 placing the liner assembly being of a cylindrical portion thereof.

35. The method of claim 32, placing the liner assembly within the casing including the liner having substantially at least the same modulus of elasticity as the casing.

36. The method of claim 35, placing the liner assembly within the casing including the liner and the casing being in the range of API Standard 5C.

37. A method for hanging a liner assembly in cylindrical casing within a well, comprising placing the liner assembly within the casing in an overlapping relationship with the liner assembly extending into the well from the casing;

holding the liner assembly in place;

expanding at least a portion of the liner assembly overlapping with the casing with the liner assembly in place partially or fully circumferentially past the yield point including expanding the cylindrical casing partially or fully circumferentially through expansion of the liner assembly, the expansion being sufficient that elastic recovery for the liner assembly is than elastic recovery for the casing, expanding the liner assembly being in the range of increased strength of the liner assembly.

38. A method for hanging a cylindrical liner assembly in cylindrical casing within a well, comprising surrounding a portion of the cylindrical liner assembly with a spacer which is substantially incompressible in a radial direction of the cylindrical liner assembly;

placing the cylindrical liner assembly within the cylindrical casing in an overlapping relationship with the cylindrical liner assembly extending into the well from the cylindrical casing;

holding the cylindrical liner assembly in place;

expanding at least a portion of the cylindrical liner assembly surrounded by the spacer and overlapping with the cylindrical casing partially or fully circumferentially past the yield point including expanding the cylindrical casing partially or fully circumferentially through expansion of the cylindrical liner assembly and the surrounding spacer.

39. The method of claim 38, expanding the cylindrical casing being within the elastic limit thereof.

40. The method of claim 39, expanding at least a portion of the cylindrical liner assembly being sufficient that elastic recovery for the cylindrical liner assembly is less that elastic recovery for the cylindrical casing.

41. The method of claim 38, the expansion being sufficient that elastic recovery for the cylindrical liner assembly is less than elastic recovery for the cylindrical casing.

42. The method of claim 38 further comprising surrounding the portion of the cylindrical liner assembly and the spacer with ductile sealing material.

43. The method of claim 38, expanding the cylindrical liner assembly being in the range of increased strength of the cylindrical liner assembly.

44. The method of claim 38, holding the cylindrical liner assembly in place using a hydraulic ram which includes a shoulder and a draw bar including abutting the shoulder of the hydraulic ram against the upper end of the cylindrical liner assembly.

45. The method of claim 44, holding the cylindrical liner assembly in place further including engaging the cylindrical liner assembly with a swedge on the draw bar of the hydraulic ram at an end of the portion of the cylindrical liner assembly to be expanded with the draw bar extending through the portion, expanding at least the portion of the cylindrical liner assembly further including drawing the swedge on the draw bar through the portion of the cylindrical liner assembly.

46. The method of claim 45, expanding at least a portion of the cylindrical liner assembly further including expanding the swedge as it is drawing through the portion of the cylindrical liner assembly.

47. The method of claim 45 further comprising releasing the cylindrical liner assembly by drawing the swedge into the shoulder of the hydraulic ram.

48. The method of claim 38, expanding at least a portion of the cylindrical liner assembly further including drawing a swedge through the portion of the cylindrical liner assembly.

49. The method of claim 48, expanding at least a portion of the cylindrical liner assembly further including expanding the swedge as it is drawing through the portion of the cylindrical liner assembly.

50. The method of claim 48 further comprising releasing the first tubular assembly using a hydraulic ram which includes a shoulder by drawing the swedge into the shoulder of the hydraulic ram.

51. The method of claim 38, placing the liner assembly within the casing including the liner having substantially at least the same modulus of elasticity as the casing.

52. The method of claim 51, placing the liner assembly within the casing including the liner and the casing being in the range of API Standard 5C.

53. A method for hanging a first tubular assembly in a second tubular positioned in a well, comprising placing the first tubular assembly within the second tubular in an overlapping relationship with the first tubular assembly extending into the well from the second tubular;

holding the first tubular assembly in place using a hydraulic ram which includes a shoulder and a draw bar including abutting the shoulder of the hydraulic ram against the upper end of the first tubular assembly;

expanding at least a portion of the first tubular assembly overlapping with the second tubular partially or fully circumferentially past the yield point including expanding the second tubular partially or fully circumferentially through expansion of the first tubular assembly, the expanding being sufficient that elastic recovery for the first tubular assembly is less than elastic recovery for the second tubular.

54. The method of claim 53, holding the first tubular assembly in place further including engaging the first tubular assembly with a swedge on the draw bar of the hydraulic ram at an end of the portion of the first tubular assembly to be expanded with the draw bar extending through the portion, expanding at least the portion of the first tubular assembly further including drawing the swedge through the portion of the first tubular assembly.

55. The method of claim 53, expanding at least the portion of the first tubular assembly further including expanding the swedge as it is drawing through the portion of the first tubular assembly.

56. The method of claim 53 further comprising releasing the first tubular assembly by drawing the swedge into the shoulder of the hydraulic ram.

57. A method for hanging a first tubular assembly in a second tubular positioned in a well, comprising placing the first tubular assembly within the second tubular in an overlapping relationship with the first tubular assembly extending into the well from the second tubular;

holding the first tubular assembly in place;

expanding at least a portion of the first tubular assembly overlapping with the second tubular partially or fully circumferentially past the yield point by drawing a swedge through the portion of the first tubular assembly including expanding the second tubular partially or fully circumferentially through expansion of the first tubular assembly, the expanding being sufficient that elastic recovery for the first tubular assembly is less than elastic recovery for the second tubular;

releasing the first tubular assembly by drawing the swedge using a hydraulic ram which includes a shoulder and a draw bar into the shoulder of the hydraulic ram.

58. A method for hanging a liner assembly in cylindrical casing within a well, comprising placing the liner assembly within the casing in an overlapping relationship with the liner assembly extending into the well from the casing;

holding the liner assembly in place using a hydraulic ram which includes a shoulder and a draw bar including abutting the shoulder of the hydraulic ram against the upper end of the liner assembly;

expanding at least a portion of the liner assembly overlapping with the casing with the liner assembly in place partially or fully circumferentially past the yield point including expanding the cylindrical casing partially or fully circumferentially through expansion of the liner assembly, the expansion being sufficient that elastic recovery for the liner assembly is less than elastic recovery for the casing.

59. The method of claim 58, holding the liner assembly in place further including engaging the liner assembly with a swedge on the draw bar of the hydraulic ram at an end of the portion of the liner assembly to be expanded with the draw bar extending through the portion, expanding at least the portion of the liner assembly further including drawing the swedge on the draw bar through the portion of the liner assembly.

60. The method of claim 59, expanding at least the portion of the liner assembly further including expanding the swedge as it is drawing through the portion of the first tubular assembly.

61. The method of claim 59 further comprising releasing the liner assembly by drawing the swedge into the shoulder of the hydraulic ram.

62. A method for hanging a liner assembly in cylindrical casing within a well, comprising placing the liner assembly within the casing in an overlapping relationship with the liner assembly extending into the well from the casing;

holding the liner assembly in place;

expanding at least a portion of the liner assembly overlapping with the casing with the liner assembly in place partially or fully circumferentially past the yield point by drawing a swedge through the portion of the liner assembly and including expanding the cylindrical casing partially or fully circumferentially through expansion of the liner assembly, the expansion being sufficient that elastic recovery for the liner assembly is less than elastic recovery for the casing.

63. The method of claim 62, expanding at least a portion of the liner assembly further including expanding the swedge as it is drawing through the portion of the liner assembly.

64. The method of claim 62 further comprising releasing the liner assembly using a hydraulic ram which includes a shoulder and a draw bar by drawing the swedge into the shoulder of the hydraulic ram.

* * * * *

UNITED STATES PATENT AND TRADEMARK OFFICE

CERTIFICATE OF CORRECTION

PATENT NO. : 6,098,717
DATED : August 8, 2000
INVENTOR(S) : Bailey et al.

It is certified that error appears in the above-identified patent and that said Letters Patent is hereby corrected as shown below:

Claim 32, column 9,
Line 60, after "is" insert -- less --.

Claim 37, column 10,
Line 22, after "is" insert -- less --.

Claim 55, column 11,
Line 52, delete "53" and insert therefor -- 54 --.

Claim 56, column 11,
Line 56, delete "53" and insert thererfor -- 54 --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*